US005314079A

United States Patent [19]

Young

[11] Patent Number: 5,314,079

[45] Date of Patent: May 24, 1994

[54] CARRIER FOR GOLF CLUBS OR THE LIKE

[76] Inventor: Michael R. Young, 9110 E. Country Walk, Wichita, Kans. 67206

[21] Appl. No.: 28,310

[22] Filed: Mar. 9, 1993

[51] Int. Cl.[5] ..... A63B 55/00

[52] U.S. Cl. ..... 211/70.2; 248/96; 206/315.2; 273/32 E

[58] Field of Search ..... 211/70.2, 14; 206/315.2, 315.7; 294/146, 143, 159; 248/96; 273/32 E, 32 D

[56] References Cited

U.S. PATENT DOCUMENTS

| | | | |
|---|---|---|---|
| 1,696,062 | 12/1928 | Thurlow et al. | 206/315.2 |
| 1,806,797 | 5/1931 | Gaiterman | 273/32 D |
| 2,570,504 | 10/1951 | Van House | 211/70.2 X |
| 2,970,629 | 2/1961 | Masten | 294/143 X |
| 3,164,185 | 1/1965 | Ingoldt | 206/315.2 X |
| 3,172,681 | 3/1965 | Moses | 211/70.2 X |
| 3,954,239 | 5/1976 | Kerbs, Jr. | 294/146 X |
| 3,966,051 | 6/1976 | Hollister et al. | 294/143 X |
| 4,834,444 | 5/1989 | Young | 206/315.2 X |

*Primary Examiner*—Blair M. Johnson

[57] ABSTRACT

An elongated carrier for golf clubs or the like having a longitudinal axis and adapted for substantially upright positioning on the ground, the carrier having upper, intermediate and lower supports, a plurality of substantially round tubular holders of semi-rigid plastic material, held in fixed, substantially parallel, juxtaposed relationship by the supports with the bottom ends thereof being affixed to the lower support, the lower support providing a floor for the holders the ends of which lie substantially in the same plane on the floor which is oriented substantially normal to the longitudinal axis of the carrier, a plurality of spikes affixed to the lower support and extending substantially axially and outwardly therefrom and adapted to penetrate into the ground to support the carrier in a substantially upright posture, and a handle affixed to the upper support and extending generally longitudinally of the carrier and outwardly from the outer surface of the upper support, the handle having a hand grip segment oriented at an angle with respect to the longitudinal axis of from about 5° to about 35°, the grip segment being positioned slightly forward of the center of gravity of the carrier in its loaded condition and thus adapted to lie substantially horizontally when the carrier is being supported by the hand of a user and is at an upwardly tilted attitude. The carrier can also feature an easy-to-use protector device for covering the spike ends.

5 Claims, 4 Drawing Sheets

Fig. 1

CARRIER FOR GOLF CLUBS OR THE LIKE

FIELD OF THE INVENTION

This invention concerns carrying devices for golf clubs and golfing paraphernalia, or for other such elongated articles as croquet mallets or the like, and particularly concerns such a device having novel means by which it can quickly and easily be positioned substantially upright on the ground, in secure but easily removable attachment thereto.

BACKGROUND OF THE INVENTION

Present day golfing typically involves the transportation of heavy golf bags by means of electric carts, hand pulled carts or caddies. Except for the caddies however, cart paths or other pathways must be available for the cart which rules out the use, for example, of many of the short cuts through perhaps somewhat difficult terrain which the golfer finds convenient. Moreover, it is frequently the case that a golfer wishes to play a more casual or extemporaneous round, perhaps just a few holes, and thus has no desire for carts or caddies. In such an event, the golfer may wish to use a reduced number of clubs in a light bag which can be carried without onerous physical effort and in areas which would be difficult for carts to traverse. Even the use of such a light bag has its drawbacks however, one of which is that the bag usually has to be placed (more often tossed) on the ground after a club has been selected. This often results in the club heads being banged around with each other or against the ground and becoming damaged or at least scratched up. Also, the club heads or head covers and the bag quite frequently will become soaked and coated by wet grass, leaves, twigs and other flora of the course. In addition, bending over to pick the bag up can also, for some people, be a bothersome task.

DISCUSSION OF PRIOR ART

Heretofore, various self-supporting, stand-up, hand-carried golf club carrier devices have been known, but, for one reason or another have failed to completely satisfy the using public. Such devices include those shown in U.S. Pat. Nos. 182,698; 1,596,231; 2,465,096; 3,483,996; 3,966,051; and 4,834,444, the disclosures of all of which are hereby incorporated herein by reference. The latter two of these patents are thought to be the most relevant prior art. Both of these devices however, have handle means which are not capable of supporting the loaded carrier at a desired tilt angle while allowing the users grip to remain in a substantially horizontal posture, which posture is the most comfortable position for the human hand and arm in a carrying mode.

OBJECTS OF THE INVENTION

Objects therefore of the present invention are: to provide a carrying device, particularly adapted to carrying golf clubs and golfing equipment, wherein the device has minimum weight, is easy to handle and carry in the aforesaid posture of maximum comfort, particularly over difficult terrain, and can be readily positioned and secured to the ground in upright position by ground penetrating spikes whereby the clubs, balls, tees, or the like are supported on the carrier and are off the ground and highly accessible; and to provide such device with easily removable protector or shielding means for said spikes for safety purposes.

BRIEF SUMMARY OF THE INVENTION

This and other objects hereinafter appearing have been attained in accordance with the present invention through the discovery of a carrying device structure defined as an elongated carrier for golf clubs or the like having a longitudinal axis and adapted for substantially upright positioning on the ground, comprising upper, intermediate and lower support means, a plurality of substantially round tubular holders, preferably of semi-rigid plastic material, held in fixed, substantially parallel, juxtaposed relationship by said support means with the bottom ends thereof being affixed to said lower support means, said lower support means providing floor means for said holders the bottom ends of which lie substantially in the same plane on said floor means, which plane is oriented substantially normal to said longitudinal axis of said carrier, spike means affixed to said lower support means and extending substantially axially and outwardly therefrom and adapted to penetrate into the ground to support said carrier in a substantially upright posture, and handle means affixed to said upper support means and extending generally longitudinally of said carrier and outwardly from the outer surface of said upper support means, said handle means having a hand grip segment oriented at an angle with respect to said longitudinal axis of from about 5° to about 35°, preferably from about 12° to about 25°, said grip segment being slightly forward of the center of gravity of said carrier in its loaded condition and thus adapted to lie substantially horizontally when the carrier is being supported by the hand of a user and is at an upwardly tilted attitude.

In certain preferred embodiments:

a) two of said holders are spaced apart slightly less than the diameter of a golf ball and are sufficiently flexible to be spread apart by golf balls forced therebetween, and wherein another of said holders is positioned inwardly of said two holders a distance which prevents insertion of the golf balls beyond the point where the said two holders are exerting holding pressure thereagainst;

b) a golf tee tote of resilient material is provided longitudinally between two spaced holders and is adapted to receive and retain the tees which are forced thereinto;

c) said grip member is provided with a pressure application surface having a component oriented substantially normal to said longitudinal axis for contact by the palm of a users hand for forcing said spike means into the ground; and d) a spike means protector is employed and comprises arm means pivotally attached to laterally outer portions of said lower support means, floor means on said arm means adapted to overlie the tips of said spike means when said arm means is pivoted to its closed position, friction surface means on said arm means, said surface means being frictionally engageable with a stationary portion of the carrier to releasably hold said arm means in its closed position.

BRIEF DESCRIPTION OF THE DRAWINGS

The invention will be further understood from the following description and drawings showing certain preferred, exemplary embodiments of the invention and wherein.

DETAILED DESCRIPTION OF THE DRAWINGS

Figure 2:
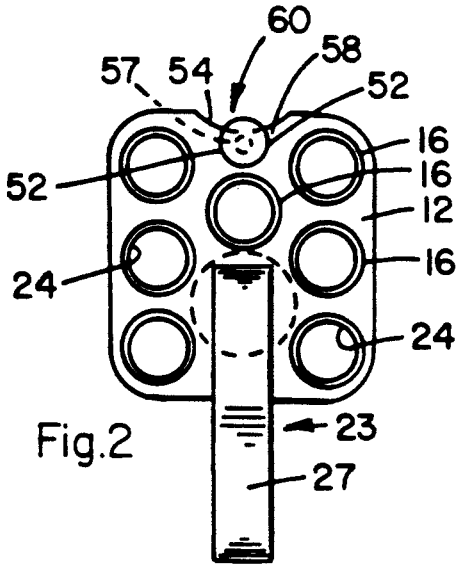
FIG. 2 is a top view of the carrier.

Referring to the drawings wherein the structures are not necessarily shown to scale, and with particular reference to the above summary of the invention, the carrier generally designated 10 having a longitudinal axis "LA" and adapted for substantially upright positioning on the ground 46, comprises upper 12, intermediate 13 and lower 14 support means, a plurality of substantially round tubular holders 16, preferably of semi-rigid plastic material, held in fixed, substantially parallel, juxtaposed relationship by said support means with the bottom ends 18 thereof being affixed to said lower support means, said lower support means providing floor means 20 for the bottom ends of said holders, which ends lie substantially in the same floor plane "FP" on said lower support means which is oriented substantially normal to said longitudinal axes of said carrier, the above structure representing the body of the carrier, spike means 22 affixed to said lower support means and extending substantially axially and outwardly therefrom and adapted to penetrate into the ground to support said carrier in a substantially upright posture, and handle means 23 affixed to said upper support means and extending generally longitudinally of said carrier and outwardly from the outer surface of said upper support means, said handle means having a hand grip segment 25 oriented at an angle with respect to said longitudinal axis of from about 5° to about 35°, preferably from about 12° to about 25°, said grip segment being slightly forward of the approximate center of gravity "CG" of said carrier in its loaded condition and thus adapted to lie substantially in a horizontal plane "HP" when the carrier is being supported by the fingers 29 of a user and is at an upward tilt attitude "TA". It is noted that the longitudinally outer portion 27 of the handle provides a convenient and comfortable pressure application surface which the palm of the users hand can press against to readily force the spikes 22 into the ground. The tilt attitude shown in FIG. 5 is fairly representative of that desired and experienced in actual use of the present invention.

Figure 3:
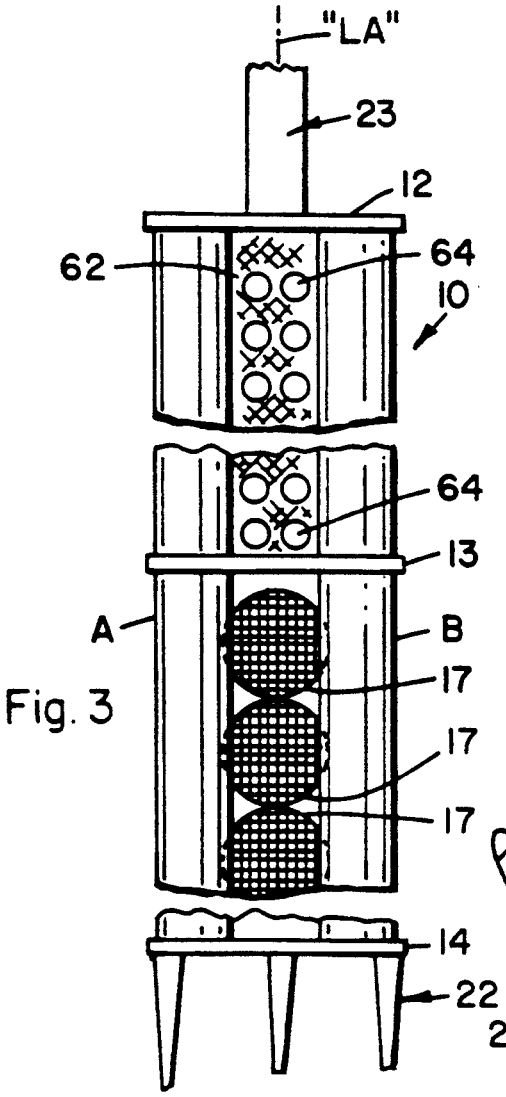
FIG. 3 is a view of the carrier rotated 90° from its position in FIG. 1.

Holders 16 are preferably formed of thin walled, e.g., 0.022 in. plastic tubing of ABS, polyolefin, polyester, polycarbonate, polyamide, cellulose ester or the like having an outside diameter preferably of about 1.25 in. and a length preferably of about 22 inches which represents a typical length for the carrier body. These dimensions may, of course, be varied. In the embodiment shown, seven holders are provided and are secured either by friction or suitable glue, volatile solvent fusion, adhesive cement, heat fusion, mechanical means or the like in apertures 24 in the supports 12 and 13 which are comprised of material such as employed for the holders. Support 13 preferably is tightly, frictionally slidable on the holders 16 and is positioned preferably about 8 in. down from support 12. It is noted that the slidable feature of support 13 allows the spacing between supports 12, 13 and 14 to be adjusted such that, for example, the positions of the tee tote 62 and the golf balls can be reversed if desired either for convenience or for adjusting the balance, i.e., center of gravity of the carrier. Also, this slidable feature is useful for adjusting the sideways deflectability of the holders and thus the required entry force for the golf balls. More or fewer holders may of course be employed, however at least two thereof should be provided as shown as A and B in FIG. 3 at the proper spacing to allow golf balls 17 to be forced therebetween. The bottom ends 18 of the holders are secured to the floor 20, preferably by means of recesses 26 formed in the lower support 14 and tightly receiving ends 18 which, as for the holders and other supports, can be adhesively cemented or otherwise joined together.

Figures 9, 10, 11, 12, 13, 14, 15:
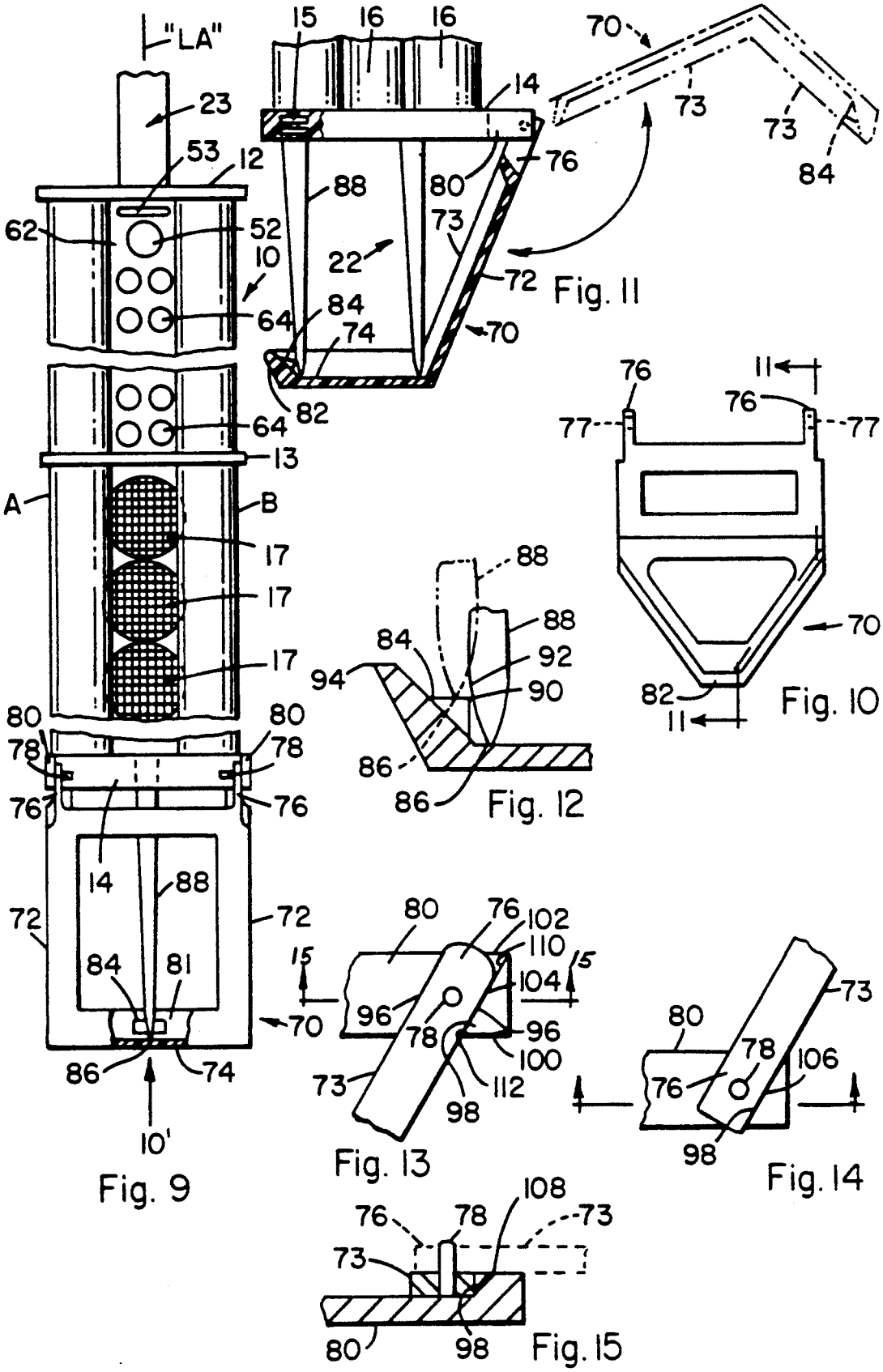
FIG. 9 is a view as in FIG. 3 with some variations.
FIG. 10 is an elevational view of the bottom of the spike protector of FIG. 9 as viewed in the direction of arrow 10 in FIG. 9.
FIG. 11 is a cross-sectional view of the spike protector of FIG. 9 taken along line 11—11 of FIG. 10 in the direction of the arrows.
FIG. 12 is an enlarged view of the front side wall 82 and adjacent structure of FIG. 11.
FIG. 13 is an elevational view of a variation of a portion of the spike means protector in operative position.
FIG. 14 is a view as in FIG. 13 in retracted position.
FIG. 15 is a cross-sectional view taken along line 15—15 of FIGS. 13 or 14.

The spike means, generally designated 22 are preferably of steel, aluminum, stainless steel, or brass, but which also may be reinforced plastic or the like, and each thereof comprises a tapered tip 28 of about 3 inches in length, and a shank 30 of about ½ to about ¾ inches in length and of about 3/16 inches in diameter. Here again, these dimensions are exemplary of a working embodiment of the present invention, and may be varied within fairly wide limits. In a preferred embodiment, as shown in FIG. 11, the spikes 22 are provided at their affixed or shank ends with ridges 15 or equivalent shoulder projections which are imbedded into plastic support 14 during the injection molding thereof. In another embodiment the spikes are secured to the carrier as shown in typical, actual size in FIG. 7, the attachment of the spikes being by means of inserting threaded shanks 30 thereof through apertures 32 in support 14 and then securing the same therein by nuts 34 threaded onto the shanks above and below the lower support means 14, thereby locking the spikes thereto. Lock washers 36 may be provided to prevent loosening of the spikes. Drain ports such as 38 can be formed in the floor 20 within the area of each holder 16 to provide for water drainage from the holders.

Figures 4, 5, 6, 7, 8:
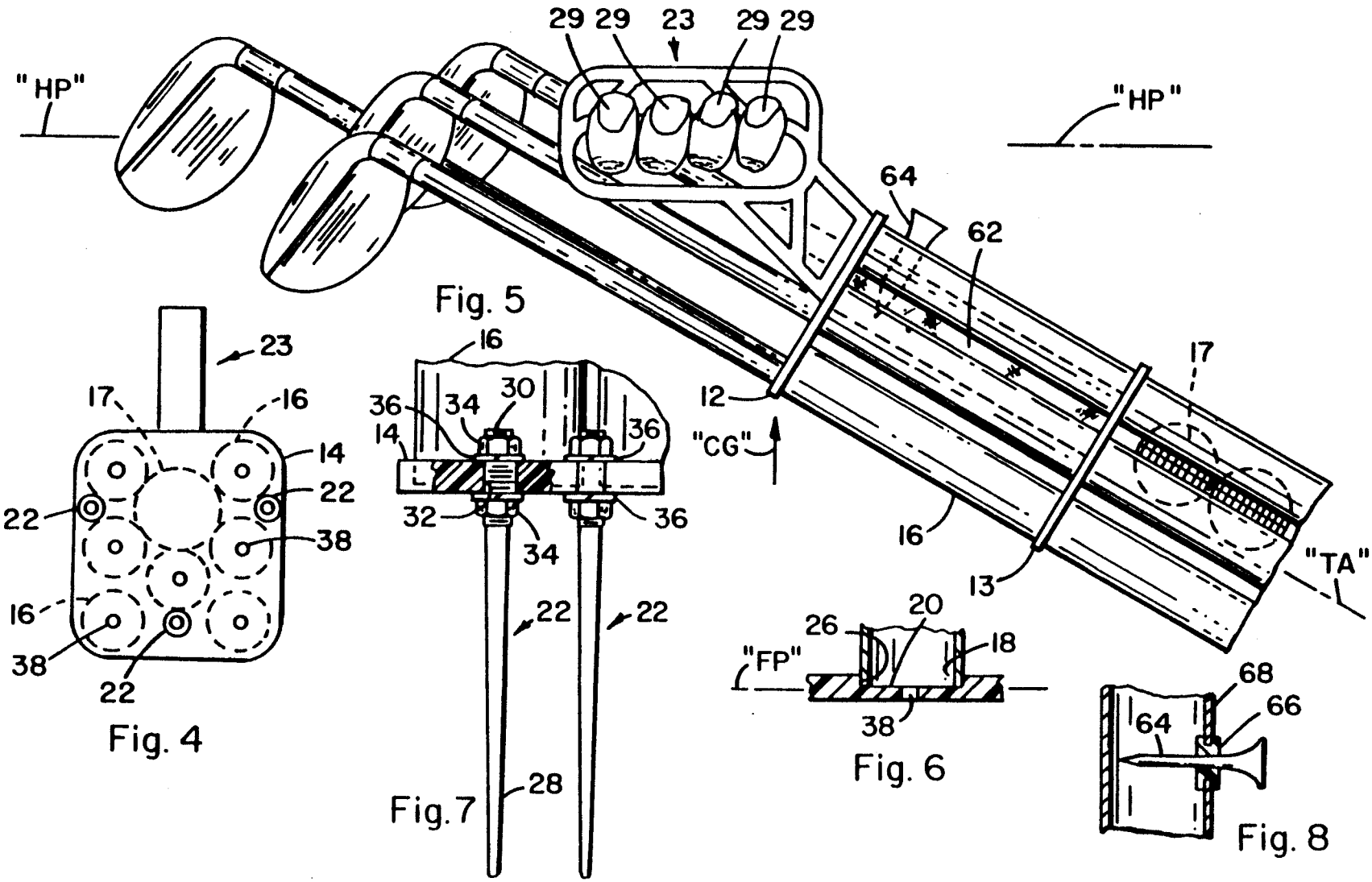
FIG. 4 is a bottom view of the carrier.
FIG. 5 is a side view of the loaded carrier in carrying operation and approximate posture and tilt angle with respect to the horizontal plane "HP"
FIG. 6 is a cross-sectional view of the preferred mounting of the holders on the floor means of the lower support means.
FIG. 7 is a partial cross-sectional view, approximately of actual size, of a preferred mounting of the spike means to the lower support means.
FIG. 8 is a cross-sectional view of a variation of the tee tote.

As shown in FIG. 4 of the aforesaid U.S. Pat. No. 4,834,444, a protector means generally designated 42 may be provided in employing the present invention to protect against accidental contact with the point of the spike, and comprises, in this preferred embodiment, an elongated, resilient, axially collapsible sleeve 44, preferably of elastomeric or other such rubbery resilient material which, upon forcible contact with the ground 46 will compress or collapse to a fraction of its normal length to thereby expose and allow ground penetration of a major portion of the spike tip. A convenient attachment means for this protector comprises the upper heavier portion 47 thereof in the form of a nut for threading onto shank 34.

Another useful variation of the spike and protector means is shown in FIG. 5 of said U.S. Pat. No. 4,834,444 wherein the spike is essentially non-tapered except at the very end thereof which is pointed, and a plastic or metal sleeve 48 is loosely slidably mounted on the spike and is normally urged to the elongated position shown by means of a light compression spring 50 to cover the sharp end of the spike. The ends of spring 50 are conveniently imbedded in the plastic sleeve and nut 40 as shown, to provide a unitary structure allowing easy connection to the floor 20 simply by threading nut 40 onto shank 34 before or after inserting the shank through aperture 36.

It is noted that the spikes, including the embodiments shown in said FIGS. 4 and 5 of said U.S. Pat. No. 4,834,444, can be mounted on other portions of the carrier than support means 14. For example, suitable brackets equivalent to the support as shown, for supporting the spikes could be located on the exterior walls of holders 16. Also, the spikes themselves could be made retractable for safety, such that they could be extended to operable position when needed, however, the embodiments shown are preferred.

Figure 1:
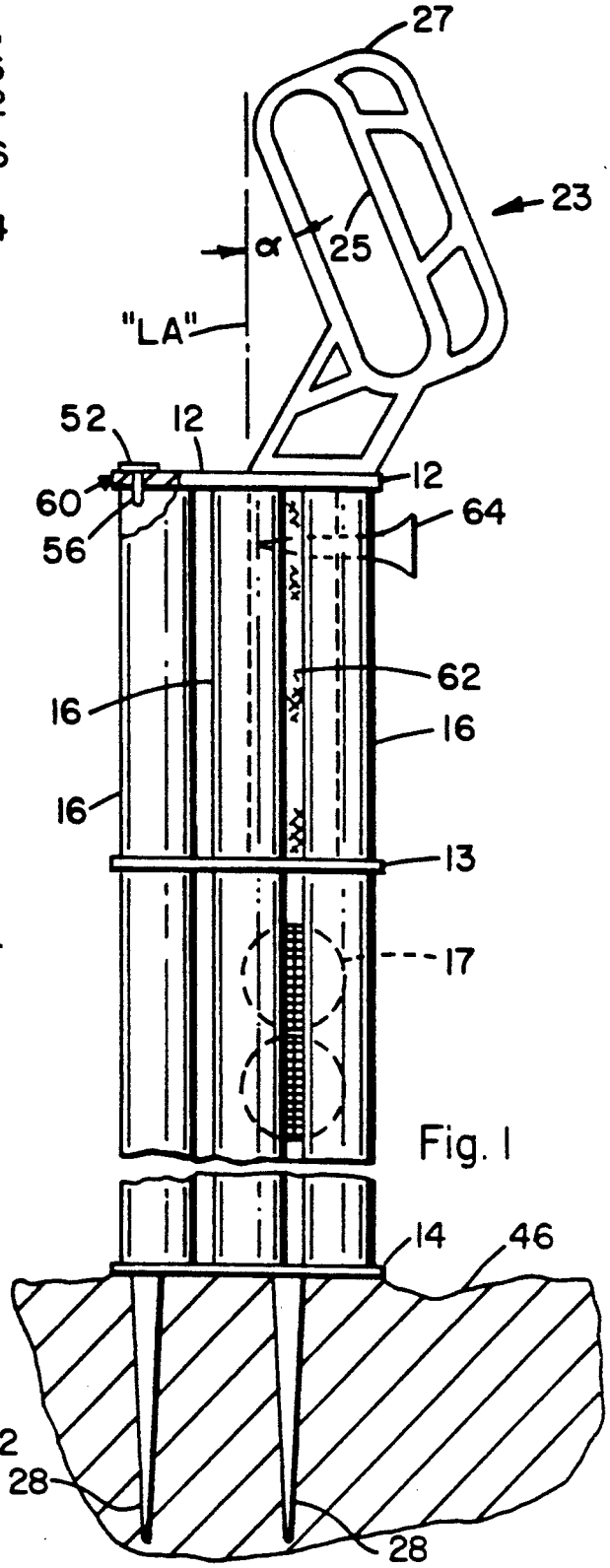
FIG. 1 is a side view of the carrier in upright operative position removably secured to the ground.

As shown in FIGS. 1 and 2, a ball marker 52 is conveniently retained on the carrier with its shank 56 frictionally but readily removably inserted through an aperture 57 in upper support means 12. A recess 54 is provided in the support means to allow finger-thumb gripping of the outer edge portion 58 of the marker lying in concavity 60 for easily removing the same from the carrier for use. This same marker holding structure may also be provided in the intermediate support means 13 if desired.

The tee tote 62 is preferably of any synthetic, sponge-like material such as air foamed PVC, polyolefin or elastomer and preferably is placed in the position shown above the golf ball rack. The material is capable of resiliently, frictionally but releasably holding onto the tees 64 when they are pushed into it. As shown in FIG. 9, tote 62 is also useful for holding ball marker 52 and other golfing implements such as a two pronged green repair tool 53. Other types of tee totes may also be used with the present invention such as the more conventional elastomeric doughnut type having friction grippers 66 as shown in FIG. 8. Such grippers, however, are preferably affixed to a more rigid support 68, such as a section of a holder tube located in the same position as tote 62.

Referring to FIGS. 9, 10, 11, 12, 16 and 17 a much preferred structure for the spike protector is shown as generally designated 70 and comprises preferably a single piece plastic molding having a mounting member 72 and a spike engaging floor means 74. Each side of member 72 forming part of arm means 73 is provided with a mounting tab 76 having an aperture 77 for rotatably receiving shaft projections 78 molded integrally on the inner sides of segments 80 of lower support means 14. Tabs 76 are sufficiently inwardly flexible to be easily mounted on projections 78. Segments 80 are formed to project laterally beyond holders 16 a sufficient distance to allow full swinging action of floor 74 away from the spike means 22 to allow the spike means to be inserted into the ground as shown in FIG. 11 in phantom outline.

The inner side 81 of front side wall 82 is formed to provide a stop surface 84 which engages the tip 86 of spike 88 to prevent inadvertent closing of the protector. When it is desired to close the protector to the position shown in FIGS. 10–12, the spike 88 is hand flexed inwardly from its dotted outline position in FIG. 12, and past ridge 90 to its operative solid line position therein. This ridge 90 engages the side 92 of the spike end and frictionally retains the protector 70 in the carrying position of FIGS. 9 and 10.

Figures 16, 17:
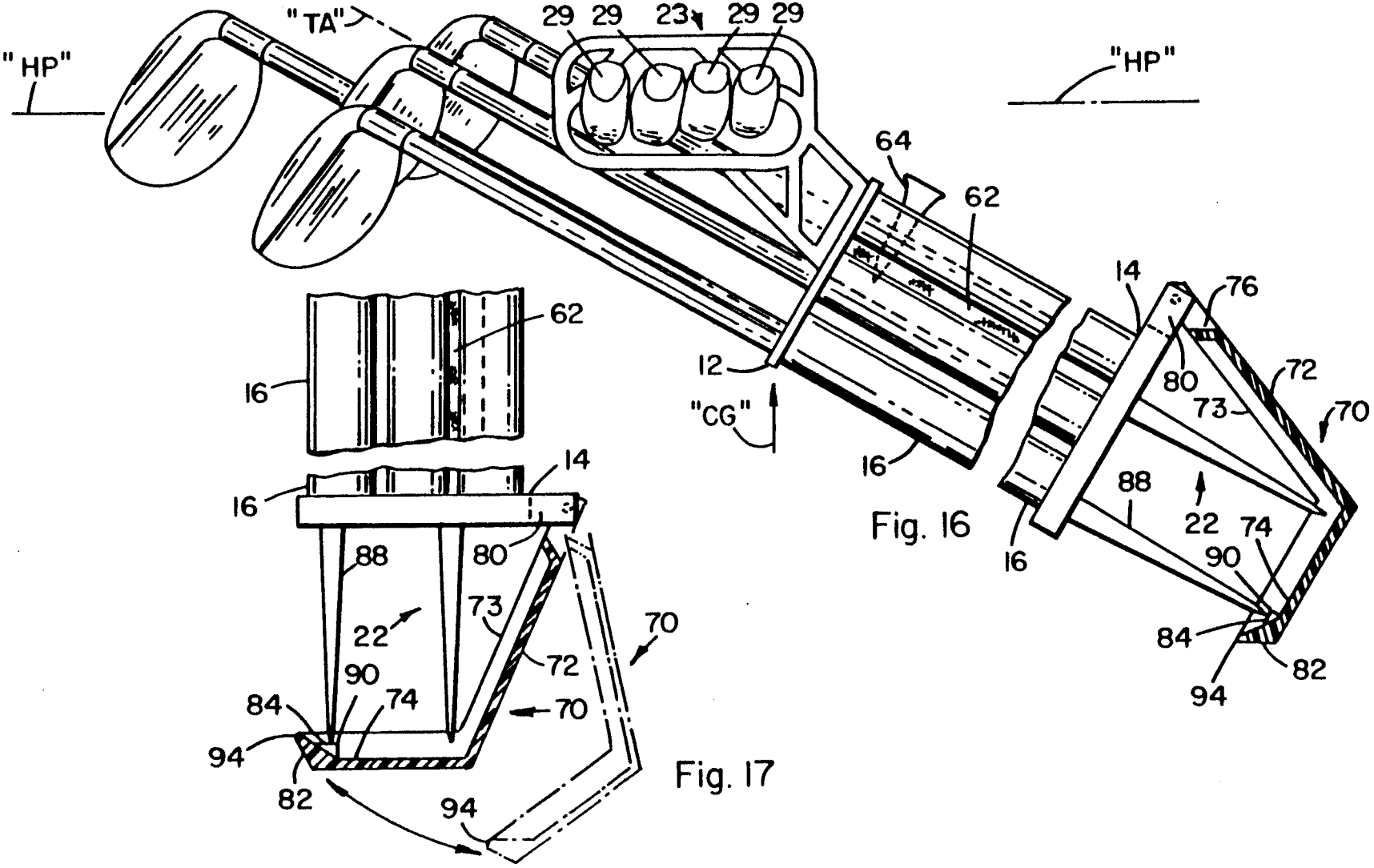
FIG. 16 is a view as in FIG. 5 with the preferred spike protector shown in its operative protective but unlocked position during normal use of the carrier in its tilted posture.
FIG. 17 is a vertically oriented view of a portion of FIG. 16 showing the protector in phantom line swung by gravity to a down position.

In the operation of protector 70, when it is desired to retract the protector and press the spikes into the ground, the leading edge 94 thereof need only to be pushed downwardly to overcome the frictional hold of ridge 90 on spike 88. When this disengagement occurs, the weight of the protector will pivot it away from the spikes to a position as shown in phantom line in FIG. 16 where slight contact of the leading edge 94 with the ground will further pivot the protector and completely expose the spike ends to allow them to be pressed into the ground. A very important feature of this preferred protector is that its shape, its center of gravity, and the position of its pivotal attachment allows the protector to assume an operative protecting posture with respect to the spikes while the carrier is being hand transported in normal golfing fashion as shown in FIG. 16. In this regard, when the carrier is to be positioned on the ground as in FIG. 1, the simple vertical orientation thereof from its carrying position of FIG. 16 will cause the protector to fall away as shown by the phantom lines in FIG. 17 whereby a slight wiping of the edge 94 of the protector across the ground will open the protector to the phantom line position of FIG. 11 to allow pressing of the spikes into the ground.

A further embodiment of useful spike means protectors is shown in FIGS. 13, 14 and 15, and with reference to claim 7 hereof comprises arm means 73 pivotally attached to laterally outer portions 80 of said lower support means 14, floor means 74 on said arm means adapted to overlie the tips 86 of said spike means when said arm means is pivoted to its closed position, friction surface means 96 on said arm means, said surface means being frictionally engageable with a stationary portion 98 of the carrier to releaseably hold said arm means in its closed position.

The position of arm 73 as shown in FIG. 13 effects the closed position of the protector as shown in FIG. 11, and the position thereof shown in FIG. 14 effects the dotted position of the arm shown in FIG. 14. The above referred to stationary portion 98 is a cam surface extending at an angle across each segment 80 from edge 100 to edge 102 thereof. The high point of this cam surface is 108, and the low points are at its end 110 and 112. The angle selected is that which will place floor 74 in the position shown in FIG. 11 when the arms 73 are rotated downwardly by hand or foot pressure from the position of FIG. 14. It is noted that the resiliency of tabs 76, whether they be plastic or metal, allows them to flex inwardly to the dotted position shown in FIG. 15 as the edges 104 and 106 comprising the friction surface means 96 ride up on the cam surface 98. It is noted that this structure gives a snap action to arms 73 as they near either of their positions of FIGS. 13 or 14 and thus eliminates the need for ridge element 90.

The invention has been described in detail with particular reference to preferred embodiments thereof, but it will be understood that variations and modifications will be effected within the spirit and scope of the invention.

I claim:

1. An elongated carrier for golf clubs or the like having a longitudinal axis and adapted for substantially upright positioning on the ground, comprising upper, intermediate and lower support means, a plurality of substantially round tubular holders of semi-rigid plastic material, held in fixed, substantially parallel, juxtaposed relationship by said support means with the bottom ends thereof being affixed to said lower support means, said lower support means providing first floor means for said holders the bottom ends of which lie substantially in the same plane on said first floor means which is oriented substantially normal to said longitudinal axis of said carrier, spike means affixed to said lower support means and extending substantially axially and outwardly therefrom and adapted to penetrate into the ground to support said carrier in a substantially upright posture, handle means affixed to said upper support means and extending generally longitudinally of said carrier and outwardly from the outer surface of said upper support means, said handle means having a hand grip segment oriented at an angle with respect to said longitudinal axis of from about 5 degrees to about 35 degrees, said grip segment being positioned slightly forward of the center of gravity of said carrier in its loaded condition and thus adapted to lie substantially horizontally when the carrier is being supported by the hand of a user and is at an upwardly tilted attitude, wherein two of said holders are spaced apart slightly less than the diameter of a golf ball and are sufficiently flexible to be spread apart by golf balls forced therebetween, and wherein another of said holders is positioned inwardly of said two holders a distance which prevents insertion of the golf balls beyond the point where the said two holders are exerting holding pressure thereagainst, wherein a tee tote is provided longitudinally between two spaced holders and adapted to receive and hold golf tees which are forced thereinto, wherein said grip segment is provided with a pressure application surface oriented substantially normal to said longitudinal axis for contact by the palm of a users hand for forcing said spike means into the ground, and wherein said upper support means has a plate-like segment lying between two of said holders and in a plane substantially normal to said longitudinal axis, said segment having a recessed outer edge portion provided with an aperture for receiving the shank of a golf ball marker with a peripheral portion of the marker top extending laterally outwardly of the carrier into the concavity of the recessed outer edge portion for ease of gripping and removal thereof.

2. The carrier of claim 1 wherein the tee tote is comprised of resilient, penetratable material.

3. An elongated carrier for golf clubs or the like having a longitudinal axis and adapted for substantially upright positioning on the ground, comprising upper, intermediate and lower support means, a plurality of substantially round tubular holders of semi-rigid plastic material, held in fixed, substantially parallel, juxtaposed relationship by said support means with the bottom ends thereof being affixed to said lower support means, said lower support means providing first floor means for said holders the bottom ends of which lie substantially in the same plane on said first floor means which is oriented substantially normal to said longitudinal axis of said carrier, spike means affixed to said lower support means and extending substantially axially and outwardly therefrom and adapted to penetrate into the ground to support said carrier in a substantially upright posture, handle means affixed to said upper support means and extending generally longitudinally of said carrier and outwardly from the outer surface of said upper support means, said handle means having a hand grip segment oriented at an angle with respect to said longitudinal axis of from about 5 degrees to about 35 degrees, said grip segment being positioned slightly forward of the center of gravity of said carrier in its loaded condition and thus adapted to lie substantially horizontally when the carrier is being supported by the hand of a user and is at an upwardly tilted attitude, wherein said lower support means is provided with spike means protector means comprising arm means pivotally attached to laterally outer portions of said lower support means second, floor means on said arm means adapted to overlie the tips of said spike means when said arm means is pivoted to its closed position, friction surface means on said arm means, said surface means being frictionally engageable with a stationary portion of the carrier to releaseably hold said arm means in its closed position.

4. The carrier of claim 3 wherein said friction surface means is on said floor means and said stationary portion is the end portion of said spike means.

5. The carrier of claim 4 wherein said friction surface means is provided on the outer edge of a cam surface which is adapted to engage the tip of said spike means and deflect it over and past said friction surface means.

* * * * *